United States Patent [19]

Pringle

[11] 4,161,219

[45] Jul. 17, 1979

[54] PISTON ACTUATED WELL SAFETY VALVE

[75] Inventor: Ronald E. Pringle, Houston, Tex.

[73] Assignee: Camco, Incorporated, Houston, Tex.

[21] Appl. No.: 881,484

[22] Filed: Feb. 27, 1978

[51] Int. Cl.[2] ..... E21B 43/12

[52] U.S. Cl. ..... 166/324; 251/62

[58] Field of Search ..... 166/319, 321, 324; 251/62

[56] References Cited

U.S. PATENT DOCUMENTS

| | | | |
|---|---|---|---|
| 2,798,561 | 9/1957 | True | 166/321 |
| 3,626,969 | 12/1971 | Garrett | 166/319 |
| 3,747,618 | 7/1973 | Boes | 251/62 X |
| 3,799,258 | 3/1974 | Tausch | 166/72 |
| 4,009,756 | 3/1977 | Zehren | 166/321 |

*Primary Examiner*—William Pate, III

*Attorney, Agent, or Firm*—Fulbright & Jaworski

[57] ABSTRACT

In a well safety valve for controlling the fluid flow through a well conduit in which the valve has a housing and a valve element movable in the housing between an open and closed position for controlling the flow through a passageway in the housing and means for biasing the valve element to a closed position, the improvement in piston means for moving the valve element into an open position. A piston is telescopically mounted in the housing, is controlled by fluid from the well surface, and is offset from the passageway. The piston has a small cross-sectional area for reducing the effect of hydrostatic forces acting on the piston whereby the valve may be used at greater depths in the well. The piston has a diameter smaller than the diameter of the valve passageway for ease of manufacture and less expense. Preferably the piston is positioned within the wall of the housing, and may be a solid cylinder or may be tubular one outside diameter with a second lower section of a greater outside diameter. Preferably, the piston is attached to and actuates a tubular member which controls the movement of the valve closure member and has a cross-sectional area less than the cross-sectional area of the tubular member.

5 Claims, 6 Drawing Figures

11
32
12
46
12
10
14
44
40
22
42
30
26

26
28
22
14
16
20
24
18

PISTON ACTUATED WELL SAFETY VALVE

BACKGROUND OF THE INVENTION

Generally, it is old to provide a subsurface well safety valve for use in a well for shutting off flow of well fluids through the well tubing. U.S. Pat. Nos. 3,782,416; 3,786,865; and 3,799,258 disclose such safety valves in which the valve is biased to an open position and is closed by a piston in response to fluid applied from the well surface. However, the means biasing the valve to a closed position must overcome the hydrostatic head in the hydraulic control line to the piston. Because the hydrostatic force increases with depth, present-day piston actuated safety valves are limited in their depth of operation. For example, present-day spring closed valves are unable to function at depths greater than approximately 700 to 800 feet. Furthermore, the present-day pistons annularly surround the tubular member and are of a greater diameter than the valve passageway and increase the cost and complexity of manufacture.

The present invention is directed to an improved piston-actuated subsurface well safety valve in which the hydrostatic forces acting on the piston are reduced thereby allowing the safety valve to be utilized at much greater depths in the well and in which the cost and ease of manufacture are reduced.

SUMMARY

The present invention is directed to a subsurface well safety valve which is biased to the closed position and opened by a piston actuated from the well surface in which the longitudinal axis of the piston is offset from the axis of the valve passageway. This allows the cross-sectional area and the diameter of the piston to be reduced thereby (1) reducing hydrostatic forces acting on the piston so that the valve may be used at a greater depth in the well, (2) decreases the cost of manufacture, (3) increases the ease of manufacture, (4) moves the piston seals to a more remote location from the well fluid, and (5) allows the piston to be varied in size more easily for various applications.

The valve includes a housing and a valve element in the housing movable between an open and closed position for controlling the flow through a passageway in the housing and means for causing the valve element to move to a closed position. At least one piston is provided telescopically movable in the housing and has a smaller diameter than the diameter of the passageway. The longitudinal axis of the piston is offset from the longitudinal axis of the passageway. The piston may be a solid cylinder. However, in order to increase the strength of the piston, the piston may be a tube having a first upper section of one outside diameter and a second lower section of a greater outside diameter in which the actuating fluid acts on an area created by the difference between the cylindrical diameters.

Still a further object of the present invention is the provision of a safety valve having a housing and closure member with a longitudinally movable tubular member controlling the movement of the valve closure member and means for biasing the tubular member in a direction for causing the valve closure member to move to the closed position. At least one piston is telescopically provided enclosed within the wall of the housing and outside of the tubular member.

Yet a further object of the present invention is the provision of connecting the piston to the tubular member for assisting the movement of the tubular member to a closing position by well tubing pressure when fluid control pressure is removed from the piston.

Still a further object is the provision of a plurality of pistons equally spaced around the valve passageway.

Other and further objects, features and advantages will be apparent from the following description of presently preferred embodiments of the invention, given for the purpose of disclosure and taken in conjunction with the accompanying drawings.

DESCRIPTION OF THE PREFERRED EMBODIMENT

While the present improvement in a subsurface well safety valve will be shown, for purposes of illustration only, as incorporated in a flapper-type tubing retrievable safety valve, it will be understood that the present invention may be used with other types of safety valves and safety valves having various types of valve closing elements.

Figure 1A:
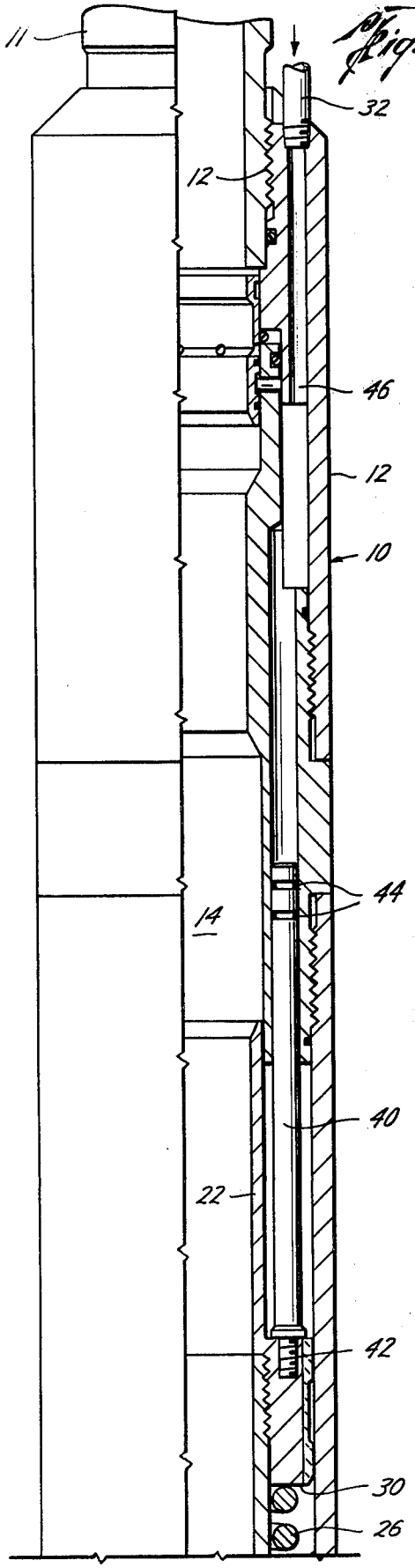
FIGS. 1A and 1B are continuations of each other of a fragmentary elevational view, partly in cross section, of a well safety valve utilizing one form of the present invention and shown in the open position.
Figure 1B:
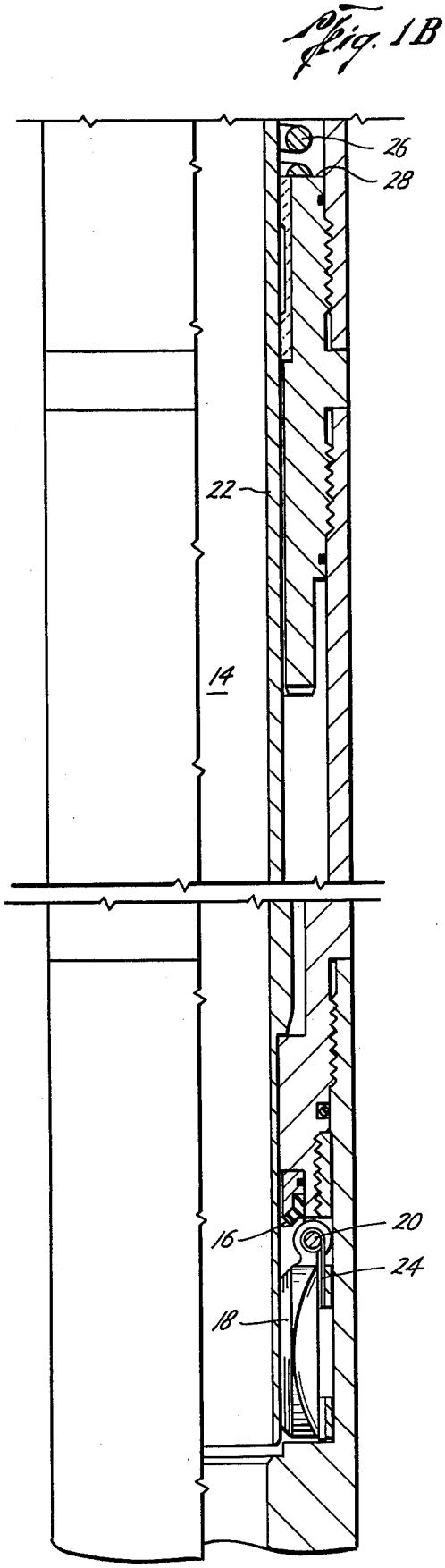

Referring now to the drawings, and in particular to FIGS. 1A and 1B, the subsurface safety valve of the present invention is generally indicated by the reference numeral 10 and is shown as being of a nonretrievable type for connection in a well conduit or well tubing 11 such as by a threaded box 12 at one end and a threaded pin (not shown) at the other end for connecting the safety valve 10 directly into the tubing 11 of an oil and/or gas well. The safety valve 10 generally includes a body or housing 12 adapted to be connected in a well tubing to form a part thereof and to permit well production therethrough under normal operating conditions, but in which the safety valve 10 may close or be closed in response to abnormal conditions such as might occur when the well overproduces, blows wild, or in event of failure of well equipment.

The safety valve 12 generally includes a bore 14, an annular valve 16 positioned about the bore 14, a valve closure element or flapper valve 18 connected to the body 12 by a pivot pin 20. Thus, when the flapper 18 is in the upper position and seated on the valve seat 16 (FIG. 2), the safety valve 10 is closed blocking flow upwardly through the bore 14 and the well tubing 11. A sliding tube or tubular member 22 is telescopically movable in the body 12 and through the valve seat 16.

As best seen in FIG. 1B, when the tubular member 22 is moved to a downward position, the tube 22 pushes the flapper 18 away from the valve seat 16. Thus, the valve 10 is held in the open position so long as the sliding tube 22 is in the downward position. When the sliding tube 22 is moved upwardly, the flapper 18 is allowed to move upwardly onto the seat 16 by the action of a spring 24 and also by the action of fluid flow moving upwardly through the bore 14 of the body 12.

Various forces may be provided to act on the tubular member 22 to control its movement so that under operating conditions the tubular member 22 will be in the downward position holding the flapper 18 away from and off of the valve seat 16 so that the valve 10 will be open. When abnormal conditions occur, the tubular member 22 will be moved upwardly allowing the flapper 18 to close shutting off flow to the valve 10 and well tubing 11. Thus, biasing means, such as a spring 26 or a pressurized chamber (not shown), may act between a shoulder 28 on the valve body 12 and a shoulder 30 connected to the tubular member 22 for yieldably urging the tubular member 22 in an upward direction to release the flapper 18 for closing the valve 10.

The safety valve 10 is controlled by the application or removal of a pressurized fluid, such as hydraulic fluid, through a control path or line, such as control line 32 extending to the well surface or the casing annulus (not shown), which supplies a pressurized hydraulic fluid to the top of a piston which in turn acts on the tubular member 22 to move the tubular member 22 downwardly forcing the flapper 18 off of the seat 16 and into the full open position. If the fluid pressure in the conduit 32 is reduced sufficiently relative to the forces urging the tubular member 22 upwardly, the tubular member 22 will be moved upwardly beyond the seat 16 allowing the flapper 18 to swing and close the seat 16.

The above description is generally disclosed in the aforementioned patents. However, it is to be noted that the safety valve 10 will be positioned downhole in a well and the control line 32 will be filled with a hydraulic fluid which exerts a downward force on the piston in the valve 10 at all times regardless of whether control pressure is exerted or removed from the control line 32. This means that the upwardly biasing means, such as the spring 26, must be sufficient to overcome the hydrostatic pressure forces existing in the control line 32. This in turn limits the depth at which the safety valve 10 may be placed in the well. Present day hydraulically controlled spring biased subsurface well safety valves are generally limited to a depth of approximately 700 to 800 feet, but it is desirable that such safety valves be operable at greater depths. The present invention is directed to a piston actuated well safety valve 10 which has a piston offset from the passageway to provide a smaller piston area exposed to the fluid in the control line 32 thereby decreasing the hydrostatic forces acting upon the piston thereby allowing the valve 10 to be used at greater depths in the well such as several thousand feet, and a piston having a smaller diameter providing both manufacturing and operating advantages. Some present forms of piston actuated well safety valves, such as shown in the aforementioned patents, utilize an annular piston connected to and positioned about the tubular member 22. While theoretically the size of such a piston could be reduced for reducing hydrostatic forces such a modification is not practical because (1) existing tolerances on such a larger annular piston makes it difficult to achieve desirable accuracy, (2) the large annular seals on the large annular piston would create too large a drag on the operation of the tubular member 22 and (3) the costs are increased.

The present invention is directed to providing a piston 40 which is telescopically movable in the housing 12 and which has a small cross-sectional area, such as having a diameter smaller than the diameter of the passageway 14 or of the tubular member 22, for reducing hydrostatic forces acting through the control line 32 thereby allowing the valve to be used at greater depths in the well. The longitudinal axis of the piston 40 is eccentric to or offset from the longitudinal axis of the passageway 14 and housing 12 and preferably is enclosed within the wall of the housing 12 and outside of the tubular member 22. If desired, more than one piston 40 may be provided equally spaced around the member 22, and preferably the piston 40 is connected to the tubular member 22 such as by a threaded connection 42 whereby fluid pressure in the bore 14 may act against the bottom of one or more piston seals 44 for assisting a sticky tubular member 22 to move to the closed position when fluid control pressure is removed from the control line 32. The safety valve 10 is controlled by the application or removal of a pressurized fluid through the control line 32 and fluid passageway 46 in the housing 12 to supply a pressurized fluid to the top of the piston 40. When pressure is applied through the control line 32, the piston 44 and tubular member 22 will be moved downwardly forcing the flapper 18 off of the valve seat 16 and into the full open position as best seen in FIGS. 1A and 1B. If the fluid pressure in the control line 32 is reduced sufficiently relative to the biasing forces urging the tubular member 22 upwardly, the tubular member 22 will be moved upwardly beyond the seat 16 allowing the valve element 18 to swing and close the valve seat 16. It is to be noted that because of the small cross-sectional area of the piston 40, that only a small hydrostatic force (force is equal to pressure times area) acts on the piston 40. Thus the biasing means, such as the spring 26, can more readily overcome such hydrostatic forces thereby allowing the valve 10 to be operated at greater depths than conventional safety valves. Therefore, a valve having a standard spring 26 will allow the valve 10 to close at a higher hydrostatic pressure.

Furthermore, the offset piston 40 allows a piston of smaller diameter and cross-sectional area to be used which reduces seal drag, allows better control of piston size since tolerances are not a great factor, and reduces the cost and complexity of manufacture. For comparison, a conventional $2\frac{7}{8}$ inch safety valve has a cross-sectional area of about 1.2 square inches while the piston 40 of the present apparatus may be 0.196 square inches.

Figure 2:
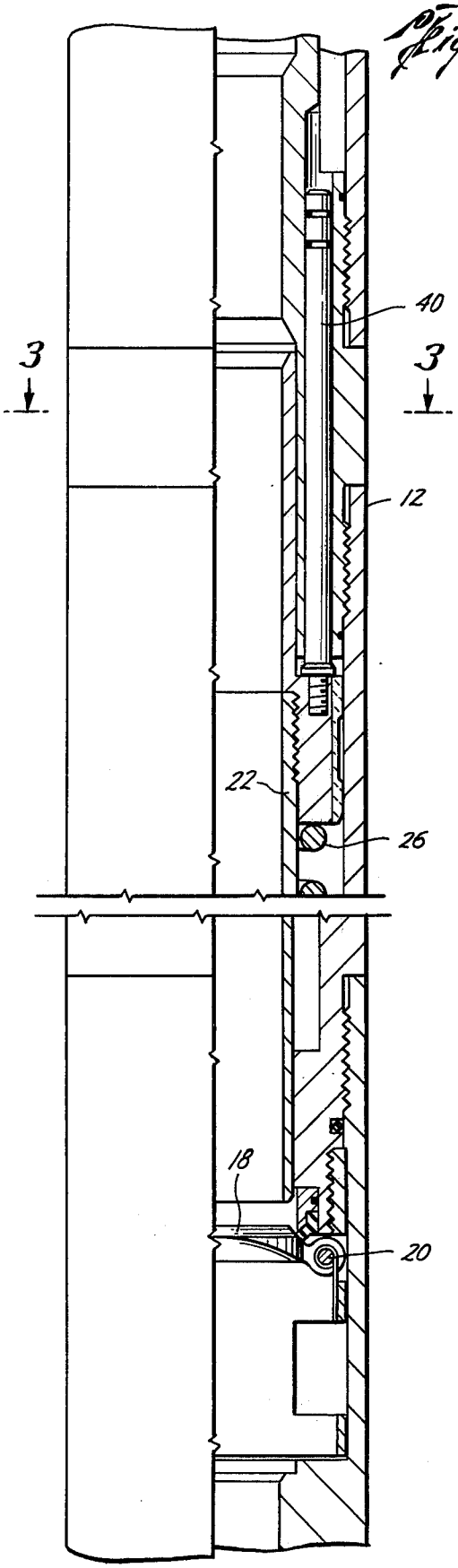
FIG. 2 is a fragmentary elevational view, partly in cross section, of the safety valve of FIGS. 1A and 1B, but shown in the closed position.
Figure 3:
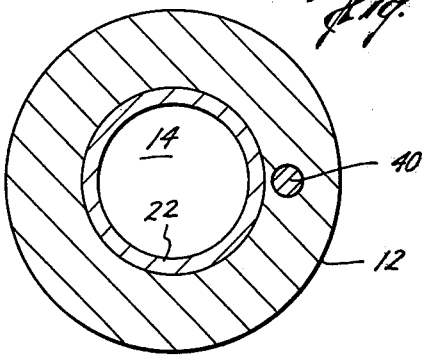
FIG. 3 is a cross-sectional view taken along the line 3—3 of FIG. 2.
Figure 4:
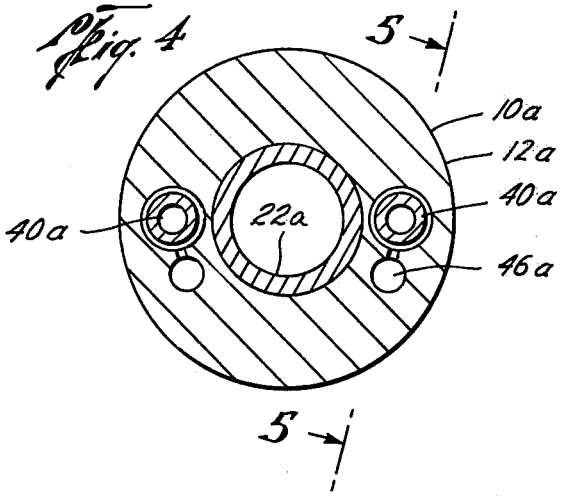
FIG. 4 is a cross-sectional view of another form of actuating piston means.
Figure 5:
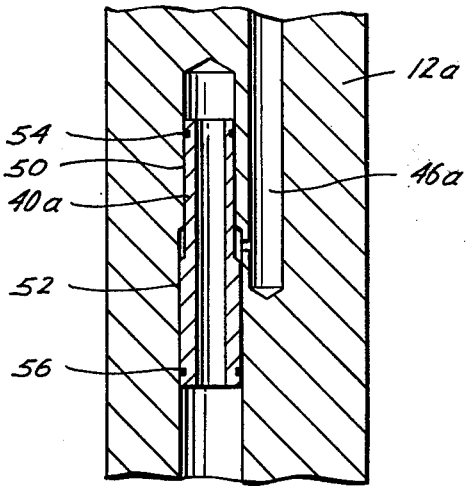
FIG. 5 is a cross-sectional view taken along the line 5—5 of FIG. 4.

Therefore, the present valve 10 may be used at greater depths by decreasing the cross-sectional area of the piston 40 to a small cross-sectional area. However, if the cross-sectional area and the diameter of the piston 40 is decreased too much, there will be a tendency for a small piston 40 to buckle under high opening pressure. In event of such a possibility, the embodiment of FIGS. 4 and 5 may be used wherein like parts to those shown in FIGS. 1–3 are similarly numbered with the addition of the suffix "a." FIG. 4 shows a full cross-sectional view of a safety valve **10*a* utilizing two pistons 40*a* if desired. The pistons 40*a* may be tubularly shaped and of a greater diameter for withstanding axial loads. The pistons 40*a* have a first upper section 50 of one outside diameter and a second lower section 52 of a greater outside diameter and piston rings 54 and 56. The fluid passageway 46*a* is in communication with the exterior of the piston 40*a* between the seal 54 and 56 and therefore acts upon a cross-sectional area proportional to the difference between the diameters of sections 50 and 52 thereby acting upon a small effective cross-sectional piston area for keeping the hydrostatic forces to a minimum. However, a tubular piston 40*a* may be made of a sufficient diameter to prevent it from bending even under high operating pressures. It is also noted that the piston 40***a*, while not being directly connected to the tubular member 22, but merely acts against a shoulder thereon, could also be attached to the tubular member 22 in the same manner as in the embodiment of FIGS. 1A through 3.

The present invention, therefore, is well adapted to carry out the objects and attain the ends and advantages mentioned as well as others inherent therein. While presently preferred embodiments of the invention have been given for the purpose of disclosure, numerous changes in the details of construction and arrangement of parts will be readily apparent to those skilled in the art and which are encompassed within the spirit of the invention and the scope of the appended claims.

What is claimed is:

1. In a well safety valve for controlling the fluid flow through a well conduit and including a tubular housing and a valve closure member moving between open and closed positions, a longitudinally tubular member telescopically movable in the housing for controlling the movement of the valve closure member, means for biasing the tubular member in a first direction for causing the valve closure member to move to the closed position, the improvement in means for moving the tubular member in a second direction for opening the valve closure member comprising, at least one piston telescopically movable within and having its longitudinal axis within the wall of the housing and outside of the tubular member, said piston contacting said tubular member, one side of the piston being in communication with hydraulic fluid extending to the well surface for actuating said member in the second direction to open said valve closure member, the second side of the piston being exposed to fluid pressure in the valve housing tending to move the piston in the first direction, and said piston having a cross-sectional width less than the thickness of the housing for reducing the hydrostatic force of the hydraulic fluid acting on the one side of the piston whereby the valve may be used at greater depths in the well.

2. The apparatus of claim 1 wherein the piston is connected to the tubular member whereby the well fluid pressure acting against the second side of the piston in opposition to the hydrostatic force assists moving the tubular member in a closing direction.

3. The apparatus of claim 1 or 2 wherein the piston is a solid cylinder which is directly connected to the tubular member for providing strength.

4. The apparatus of claim 3 including a plurality of pistons spaced equidistance about the tubular member.

5. The apparatus of claim 1 wherein the piston is tubular and has a first upper section of one outside diameter, a second lower section of a greater outside diameter, seals on both sections, and the hydraulic fluid acts on the piston between said seals.

* * * * *

REEXAMINATION CERTIFICATE (169th)

United States Patent [19]

Pringle

[11] B1 4,161,219

[45] Certificate Issued Feb. 28, 1984

[54] PISTON ACTUATED WELL SAFETY VALVE

[75] Inventor: Ronald E. Pringle, Houston, Tex.

[73] Assignee: Camco, Incorporated, Houston, Tex.

Reexamination Request:
No. 90/000,273, Oct. 12, 1982

Reexamination Certificate for:

| | |
|---|---|
| Patent No.: | **4,161,219** |
| Issued: | **Jul. 17, 1979** |
| Appl. No.: | **881,484** |
| Filed: | **Feb. 27, 1978** |

[51] Int. Cl.[3] ..... E21B 43/12
[52] U.S. Cl. ..... 166/324; 251/62
[58] Field of Search ..... 166/319, 321, 323, 324, 166/322, 72; 251/62

[56] References Cited

U.S. PATENT DOCUMENTS

| | | | |
|---|---|---|---|
| 2,798,561 | 7/1957 | True | 166/321 |
| 3,626,969 | 12/1971 | Garrett | 137/155 |
| 3,747,618 | 7/1973 | Boes | 251/62 X |
| 3,799,258 | 3/1974 | Tausch | 166/72 |
| 4,009,756 | 3/1977 | Zehren | 166/250 |
| 4,049,052 | 9/1977 | Arendt | 166/183 |

*Primary Examiner*—William F. Pate, III

[57] ABSTRACT

In a well safety valve for controlling the fluid flow through a well conduit in which the valve has a housing and a valve element movable in the housing between an open and closed position for controlling the flow through a passageway in the housing and means for biasing the valve element to a closed position, the improvement in piston means for moving the valve element into an open position. A piston is telescopically mounted in the housing, is controlled by fluid from the well surface, and is offset from the passageway. The piston has a small cross-sectional area for reducing the effect of hydrostatic forces acting on the piston whereby the valve may be used at greater depths in the well. This piston has a diameter smaller than the diameter of the valve passageway for ease of manufacture and less expense. Preferably the piston is positioned within the wall of the housing, and may be a solid cylinder or may be tubular one outside diameter with a second lower section of a greater outside diameter. Preferably, the piston is attached to and actuates a tubular member which controls the movement of the valve closure member and has a cross-sectional area less than the cross-sectional area of the tubular member.

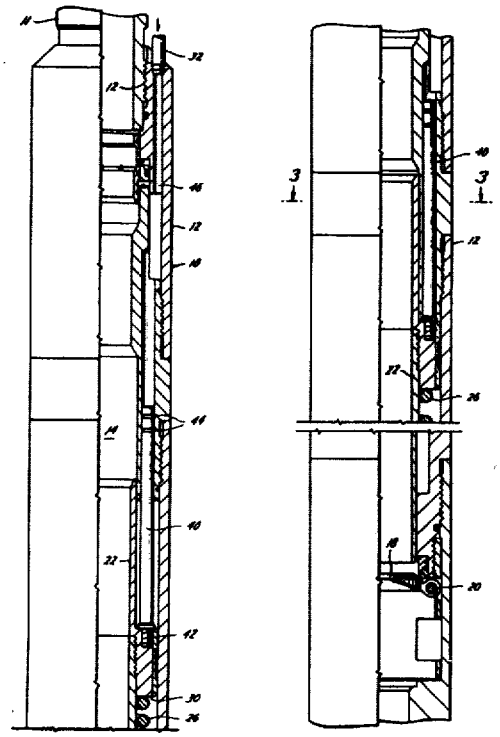

REEXAMINATION CERTIFICATE ISSUED UNDER 35 U.S.C. 307.

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 1 is determined to be patentable as amended:

Claims 2–5, dependent on amended claims, are determined to be patentable.

1. In a well *tubing* safety valve for controlling the fluid flow through a well conduit and including a tubular housing *having an axial bore therethrough* and a valve closure member moving between open and closed positions *for controlling the fluid flow through the bore*, a longitudinally tubular member telescopically movable in the housing *coaxially with the bore* for controlling the movement of the valve closure member, means for biasing the tubular member in a first direction for causing the valve closure member to move to the closed position, the improvement in means for moving the tubular member in a second direction for opening the valve closure member comprising, at least one piston telescopically movable within and having its longitudinal axis within the wall of the housing and outside of the tubular member *and offset from the bore and said valve closure member*, said piston contacting said tubular member, one side of the piston being in communication with hydraulic fluid extending to the well surface for actuating said member in the second direction to open said valve closure member, the second side of the piston being exposed to fluid pressure in the valve housing tending to move the piston in the first direction, and said piston having *a diameter smaller than the diameter of the bore and* a cross-sectional width less than the thickness of the housing *whereby the piston has a small cross-sectional area* for reducing the hydrostatic force of the hydraulic fluid acting on the one side of the piston whereby the valve may be used at greater depths in the well.

* * * * *